US012473797B2

(12) United States Patent
Al Marhoon et al.

(10) Patent No.: US 12,473,797 B2
(45) Date of Patent: Nov. 18, 2025

(54) EUTECTIC ALLOY SYSTEM FOR CONCENTRIC CASING STRING CEMENT REPAIR

(71) Applicants: SAUDI ARABIAN OIL COMPANY, Dhahran (SA); WELLBORE INTEGRITY SOLUTIONS, Damman (SA)

(72) Inventors: Zahrah Al Marhoon, Dhahran (SA); Amjad Alshaarawi, Dhahran (SA); Abdallah A. Alkubaisi, Udhailiyah (SA); Jafar S. Alzaid, Udhailiyah (SA); Khalil E. Mohamed, Udhailiyah (SA); Thomas Heinold, Dhahran (SA); Peter Egbe, Dhahran (SA); Alessandro Antonio Gallelli, Dhahran (SA); Songlin Zhong, Dhahran (SA); David Shearer, Damman (SA)

(73) Assignees: SAUDI ARABIAN OIL COMPANY, Dhahran (SA); WELLBORE INTEGRITY SOLUTIONS, Damman (SA)

( * ) Notice: Subject to any disclaimer, the term of this patent is extended or adjusted under 35 U.S.C. 154(b) by 0 days.

(21) Appl. No.: 18/634,840

(22) Filed: Apr. 12, 2024

(65) Prior Publication Data

US 2025/0320790 A1 Oct. 16, 2025

(51) Int. Cl.

| | |
|---|---|
| ***E21B 33/13*** | (2006.01) |
| ***E21B 29/06*** | (2006.01) |
| ***E21B 33/12*** | (2006.01) |

(52) U.S. Cl.

CPC ..... *E21B 33/13* (2013.01); *E21B 29/06* (2013.01); *E21B 33/1204* (2013.01)

(58) Field of Classification Search

CPC ..... E21B 29/00; E21B 29/10; E21B 29/06; E21B 33/1204; E21B 33/13

See application file for complete search history.

(56) References Cited

U.S. PATENT DOCUMENTS 7,934,552 B2 * 5/2011 La Rovere ..... E21B 29/10 166/302
7,952,352 B2 5/2011 Ogawa et al.
(Continued)

FOREIGN PATENT DOCUMENTS

CA 2683236 A1 * 4/2010 ..... E21B 33/12
CA 3059868 A1 10/2018
(Continued)

OTHER PUBLICATIONS

Wei, Lei et al. "The Recent Progress of MEMS/NEMS Resonators." Micromachines vol. 12,6 724. Jun. 19, 2021.
(Continued)

*Primary Examiner* — Jennifer H Gay
(74) *Attorney, Agent, or Firm* — Vorys, Sater, Seymour and Pease LLP

(57) ABSTRACT

A method of repairing wellbores includes setting a plug to isolate a wellbore flowpath within a plurality of concentric casing strings, milling a window through a radially innermost casing string of the plurality of concentric casing strings, via a casing milling tool, and radially outward towards one of a plurality of cement columns, cleaning out one of plurality of a cement columns between two of the concentric casing strings to expand the window radially, inserting a solid eutectic alloy into the wellbore flowpath above the plug, heating the solid eutectic alloy, via a heater inserted within the wellbore flowpath, to melt the eutectic alloy and allow the melted eutectic alloy to flow into the window, solidifying the melted eutectic alloy to form a
(Continued)

solidified eutectic plug within the window, and drilling out the solidified eutectic plug to restore the wellbore flowpath through the eutectic plug.

18 Claims, 9 Drawing Sheets

(56) References Cited

U.S. PATENT DOCUMENTS

| | | | | |
|---|---|---|---|---|
| 10,288,707 | B2 | 5/2019 | Takeda et al. | |
| 10,597,970 | B2 | 3/2020 | Pipchuk et al. | |
| 10,760,374 | B2 * | 9/2020 | Hearn | H10B 43/10 |
| 10,959,330 | B2 | 3/2021 | Ohashi et al. | |
| 11,377,925 | B2 | 7/2022 | Mueller et al. | |
| 11,421,506 | B2 * | 8/2022 | Shafer | E21B 33/12 |
| 11,440,797 | B2 | 9/2022 | Xu | |
| 11,492,870 | B2 | 11/2022 | Carragher | |
| 11,578,556 | B2 * | 2/2023 | Carragher | E21B 36/003 |
| 11,637,377 | B2 | 4/2023 | Taraschi et al. | |
| 11,753,898 | B2 | 9/2023 | Shafer | |
| 12,129,735 | B2 * | 10/2024 | Hearn | E21B 29/02 |
| 12,129,736 | B2 * | 10/2024 | Rusten | E21B 36/008 |
| 2006/0144591 | A1 * | 7/2006 | Gonzalez | E21B 29/10 166/57 |
| 2007/0051514 | A1 * | 3/2007 | La Rovere | E21B 36/00 166/57 |
| 2009/0183884 | A1 * | 7/2009 | Hansen | E21B 29/10 166/387 |
| 2010/0155085 | A1 * | 6/2010 | Spencer | E21B 33/12 166/386 |
| 2011/0203795 | A1 * | 8/2011 | Murphy | C09K 8/467 166/135 |
| 2013/0312963 | A1 * | 11/2013 | Larsen | E21B 33/13 166/376 |
| 2016/0138361 | A1 * | 5/2016 | Clemens | E21B 43/105 166/387 |
| 2016/0334317 | A1 | 11/2016 | Killard et al. | |
| 2017/0016299 | A1 * | 1/2017 | Faircloth | B23K 26/38 |
| 2017/0030162 | A1 * | 2/2017 | Carragher | E21B 36/003 |
| 2017/0139078 | A1 * | 5/2017 | Knight | G16B 10/00 |
| 2017/0247971 | A1 * | 8/2017 | Rivas Diaz | E21B 23/00 |
| 2018/0148991 | A1 * | 5/2018 | Hearn | H01L 25/50 |
| 2018/0298715 | A1 * | 10/2018 | Shafer | E21B 33/13 |
| 2019/0186233 | A1 * | 6/2019 | Shafer | E21B 33/13 |
| 2020/0173250 | A1 * | 6/2020 | Carragher | E21B 33/1208 |
| 2021/0156222 | A1 * | 5/2021 | Shafer | E21B 29/002 |
| 2022/0290526 | A1 | 9/2022 | Mueller et al. | |
| 2022/0290527 | A1 | 9/2022 | Shafer | |
| 2022/0307343 | A1 * | 9/2022 | Hearn | H01L 25/50 |
| 2022/0339609 | A1 | 10/2022 | Hu et al. | |
| 2022/0403711 | A1 | 12/2022 | Louden | |
| 2023/0184054 | A1 * | 6/2023 | Marques Pires | E21B 33/1208 166/179 |
| 2023/0313637 | A1 * | 10/2023 | Head | E21B 33/16 166/285 |
| 2024/0003221 | A1 * | 1/2024 | Carrager | E21B 33/14 |
| 2024/0117703 | A1 * | 4/2024 | Rusten | E21B 33/13 |
| 2024/0318524 | A9 * | 9/2024 | Hearn | H10B 43/10 |
| 2024/0368960 | A1 * | 11/2024 | Hitchcock | E21B 33/1204 |

FOREIGN PATENT DOCUMENTS

| | | | | |
|---|---|---|---|---|
| CN | 111781225 | A | 10/2020 | |
| CN | 114751373 | A | 7/2022 | |
| CN | 114985754 | A | 9/2022 | |
| EP | 3724445 | B1 * | 1/2022 | E21B 29/00 |
| JP | 2007240359 | A | 9/2007 | |
| WO | 2012076709 | A1 | 6/2012 | |
| WO | WO-2021250401 | A1 * | 12/2021 | E21B 23/0417 |
| WO | 2022038387 | A1 | 2/2022 | |

OTHER PUBLICATIONS

Feng, Guang et al. "Sub-2 Nm Ultrasmall High-entropy Alloy Nanoparticles for Extremely Superior Electrocatalytic Hydrogen Evolution". Sep. 23, 2021. Web. Apr. 11, 2024.

PCT International Search Report & Written Opinion pertaining to International Application No. PCT/US2025/023830; Date of Mailing: Jun. 24, 2025.

* cited by examiner

EUTECTIC ALLOY SYSTEM FOR CONCENTRIC CASING STRING CEMENT REPAIR

FIELD OF THE DISCLOSURE

The present disclosure relates generally to concentric casing string cement repair and, more particularly, to methods and systems for concentric casing cement string repair using eutectic alloy plugs.

BACKGROUND OF THE DISCLOSURE

Oil and gas wellbores are commonly drilled in a series of progressively smaller strings of casing or liner until reaching a desired depth. A wellbore drilling operation may begin with drilling into a formation to a specified depth for a first casing string, also known as a first "casing depth". The first casing string may be run downhole to the first casing depth and cemented in place by pumping cement between the formation and the first casing string to form a first stage cement column. The operation may continue with drilling to a second casing depth and running a second casing string downhole through the first casing string. The second casing string may then be cemented in place with a second stage cement column formed by pumping cement upward between the second casing string and the formation and continuing upward through a "casing-casing annulus" defined between the first casing string and the second casing string. The operation may continue with subsequent drilling and cementing stages until reaching a desired wellbore depth.

Once the drilling is complete, a string of production tubing may be installed within the innermost casing, and production operations may be initiated to recover oil and gas resources through the production tubing. During the production operations, cracks or imperfections within the cement columns may lead to leaks or failures within the cement columns. These leaks may lead to a sustained casing pressure behind one or more casing strings, which may lead to undesirable flow within one or more casing-casing annuli and negatively affect overall wellbore integrity.

To avoid costly workover operations on wellbores with sustained casing pressure, conventional methods have been developed to correct leaks or failures downhole. These conventional methods include deploying a perforation gun to form perforations within the casing strings and cement columns, and inserting a resin mixture to form a seal within the perforated area. However, the resin mixture may commonly be formed of biodegradable materials which may break down over time and lead to further leaks or failures. Further, the resin mixtures are often slow to cool and set, and may have cooling and setting times on the timescale of days before a resin plug may be drilled out to restore a flowpath downhole. Additional materials such as cement may be used to generate a plug in place of resin, but these additional materials include further drawbacks.

Accordingly, methods and systems are desired for reliably correcting leaks and failures within concentric casings.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a method of repairing wellbores includes setting a plug to isolate a wellbore flowpath within a plurality of concentric casing strings, milling a window through a radially innermost casing string of the plurality of concentric casing strings, via a casing milling tool, and radially outward towards one of a plurality of cement columns, cleaning out one of plurality of a cement columns between two of the concentric casing strings to expand the window radially, inserting a solid eutectic alloy into the wellbore flowpath above the plug, heating the solid eutectic alloy, via a heater inserted within the wellbore flowpath, to melt the eutectic alloy and allow the melted eutectic alloy to flow into the window, solidifying the melted eutectic alloy to form a solidified eutectic plug within the window, and drilling out the solidified eutectic plug to restore the wellbore flowpath through the eutectic plug.

In another embodiments, a wellbore repair system includes a plurality of concentric casing strings disposed within a wellbore, a plurality of cement columns disposed radially outward of each of the concentric casing strings, a window defined radially through at least a radially innermost casing string of the one or more of the concentric casing strings, a plug set within an interior of the radially innermost casing string below the window, and a solidified eutectic alloy filling the window above the plug, wherein the solidified eutectic alloy forms a metal-to-metal seal with at least one of the concentric casing strings.

In a further embodiment, a wellbore repair system includes a plurality of concentric casing strings disposed within a wellbore, a plurality of cement columns disposed radially outward of each of the concentric casing strings, a window defined radially through at least a radially innermost casing string of the one or more of the concentric casing strings, a plug set within an interior of the radially innermost casing string, a plurality of eutectic alloy beads inserted within the window above the plug, and a heater inserted within the window and operable to melt the plurality of eutectic alloy beads.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
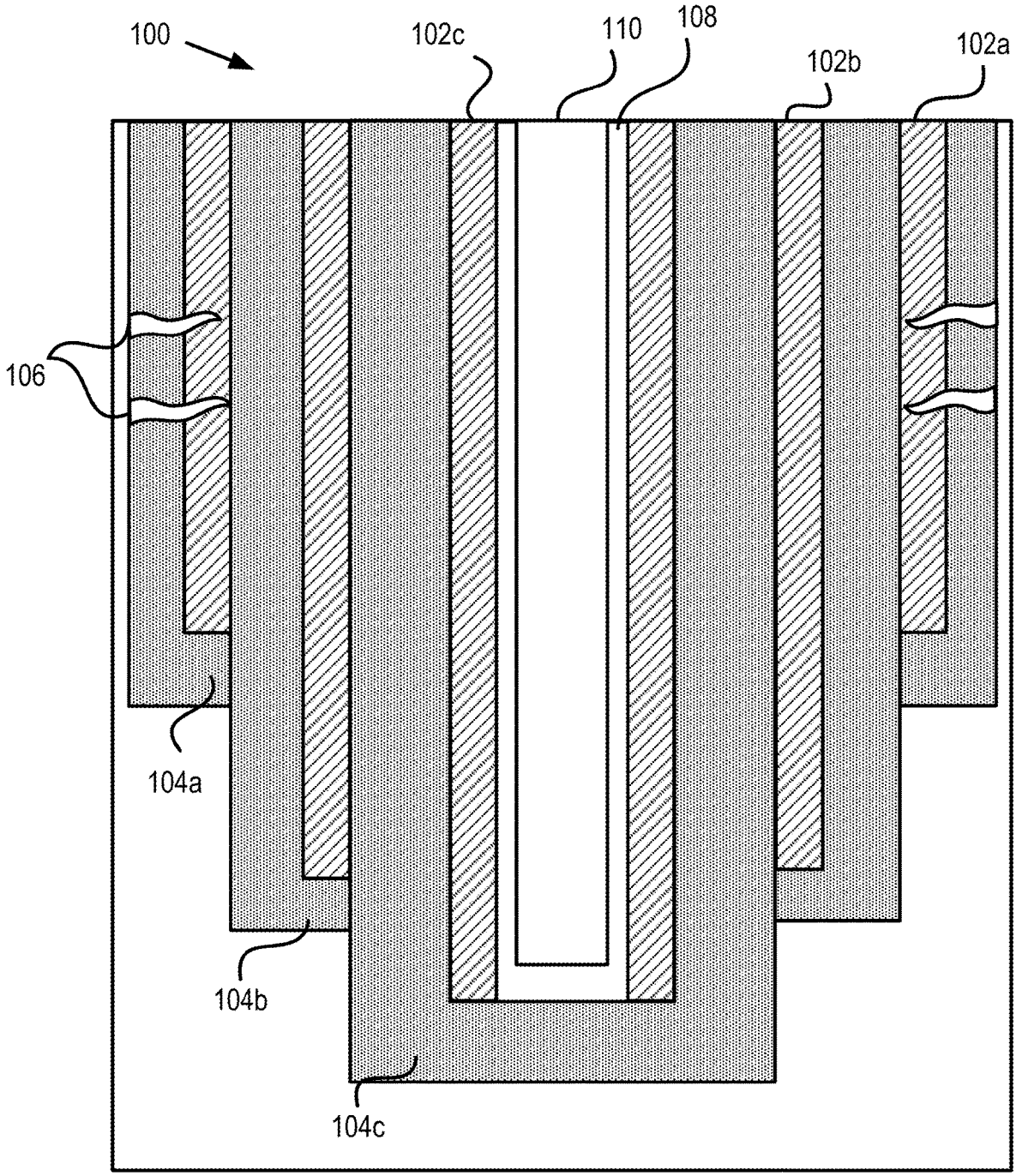
FIG. 1 is a schematic cross-sectional side view of a wellbore with sustained casing pressure within concentric casing strings therein, which may be repaired with systems and methods according to one or more embodiments of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to concentric casing cement string repair and, more particularly, to methods and systems for concentric casing string cement repair using eutectic alloy plugs. The embodiments disclosed herein include methods and systems which utilize a milled window extending through concentric casing strings and cement columns interspaced between the casing strings to approach a leak. The methods and systems may further involve introducing a solid eutectic alloy into the wellbore flowpath, followed by melting the solid eutectic alloy to introduce molten eutectic alloy into the milled window to fill in any leaks or failures. The eutectic alloy may solidify into a solidified eutectic plug to form a gas-tight seal within and around the leaks or failures. Accordingly, the methods and systems disclosed herein may enable rapid deployment and scaling of leaks causing sustained casing pressure. In some embodiments disclosed herein, supplemental barriers such as a scab liner may be introduced to further isolate the sealed leaks from any flowpaths or sensitive equipment. Progressive milling and cement cleaning may enable the sealing of leaks within the outermost concentric casing strings or cement columns without full workover operations.

FIG. 1 is a schematic cross-sectional side view of a wellbore 100 with sustained casing pressure within concentric casing strings 102*a*, 102*b*, and 102*c* therein, according to one or more embodiments of the present disclosure. The sustained casing pressure in the illustrated embodiment may be due to a failure in a cement column 104*a* around the first casing string 102*a*. In some embodiments, the first casing string 102*a* is the outermost casing string of a plurality of concentric casing string 102*a-c*. The cement column 104*a*, as shown, includes a plurality of leaks 106 which may enable flow around and/or into the first casing string 102*a* or within a casing-casing annulus between the first casing string 102*a* and second casing string 102*b*. As such, to repair the leaks 106 behind (radially outward of) or into the first casing string 102*a*, corrective operations disclosed herein may include selective removal of a portion of each casing string 102*a-c* and cement column 104*a-c* between the wellbore flowpath 108 and the leaks 106. However, any of the cement columns 104*a-c* and any of the first, second, or third casing strings 102*a-c* may include leaks or failures that may cause sustained casing pressure within the wellbore 100. Prior to, or in concert with, a beginning of repair operations within the wellbore 100, any production tubing 110 inserted therein may be retracted out of the wellbore 100.

Example progressive operation of a eutectic alloy system will now be provided with reference to FIGS. 2-7, which depict a series of cross-sectional side views of the wellbore 100, according to one or more embodiments.

Figure 2:
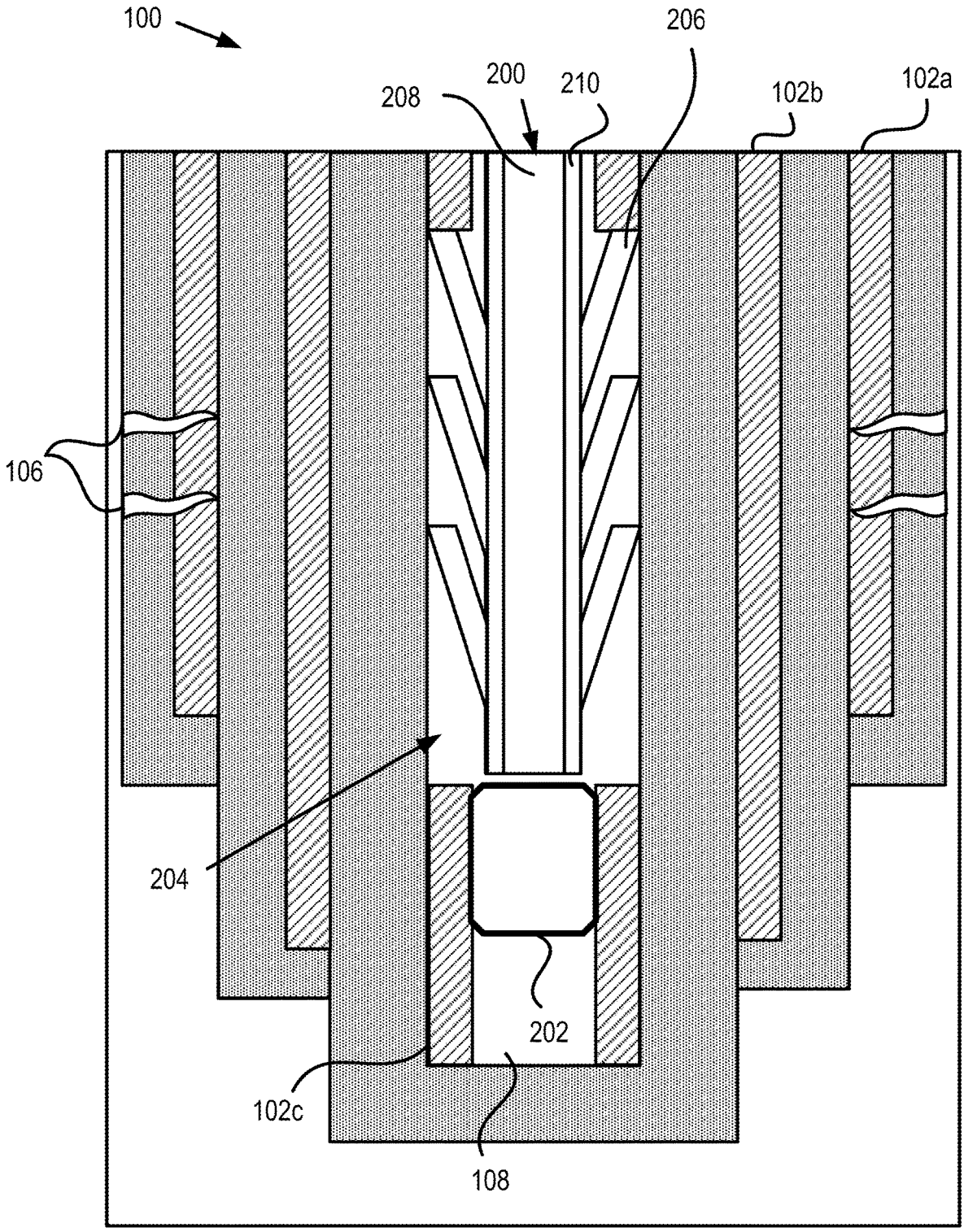
FIG. 2 is a schematic cross-sectional side view of the wellbore with production tubing removed and a casing milling tool inserted therein for progressive milling of the concentric casing strings, according to an initial step of a repair operation of one or more embodiments of the present disclosure.

FIG. 2 is a schematic cross-sectional side view of the wellbore 100 with a casing milling tool 200 inserted therein for progressive milling of the concentric casing strings 102*a-c*, according to one or more embodiments of the present disclosure. The casing milling tool 200 may be inserted into the wellbore flowpath 108 following retraction of the production tubing 110 of FIG. 1 and setting of a plug 202 within the casing string 102*c*, which may be referred to as the radially innermost casing string. The plug 202 may be set within the wellbore flowpath 108 and may isolate any lower portions of the wellbore flowpath 108 from the area surrounding the leaks 106. In some embodiments, the plug 202 may be set a certain distance below the leaks 106 as illustrated to enable correction in the local area of the leaks 106. In other embodiments, the plug 202 may be set above the leaks 106 to seal leak paths extending between the leaks 106 and a surface location. In some embodiments, the plug 202 may be a bridge plug and may be either retrievable or drillable (millable) in nature.

Following setting of the plug 202, the casing milling tool 200 may begin milling out a window 204 within the third casing string 102*c*, as illustrated. The casing milling tool 200 may include one or more retractable milling bits 206 which may be retracted (stowed) for travel within the wellbore flowpath 108. The retractable milling bits 206 may be housed within a milling body 208 of the casing milling tool 200 during travel. Upon reaching the local area of the leaks 106, or the plug 202, the retractable milling bits 206 may be deployed from the casing milling tool 200 to the position shown in the illustrated embodiment. The retractable milling bits 206 may be deployed through one or more bit slots 210 defined within the milling body 208 to enable retraction and deployment of the retractable milling bits 206 therethrough. The casing milling tool 200, and therefore the retractable milling bits 206, may be rotated within the wellbore flowpath 108 to mill out the window 204 within the third casing string 102*c*. Accordingly, the retractable milling bits 206 may be progressively (incrementally) deployable, such that the retractable milling bits 206 may continue to deploy outward as the third casing string 102*c* is milled away. In some embodiments, however, progressively larger casing milling tools 200 and retractable milling bits 206 may be inserted into the wellbore. In these embodiments, multiple runs of the casing milling tools 200 may be performed for progressive milling of the third casing string 102*c*. The window 204 may be defined between segments of the third casing string 102*c* that remain above and below the window (only the segment below the window 204 is illustrated in FIG. 2.

Figure 3:
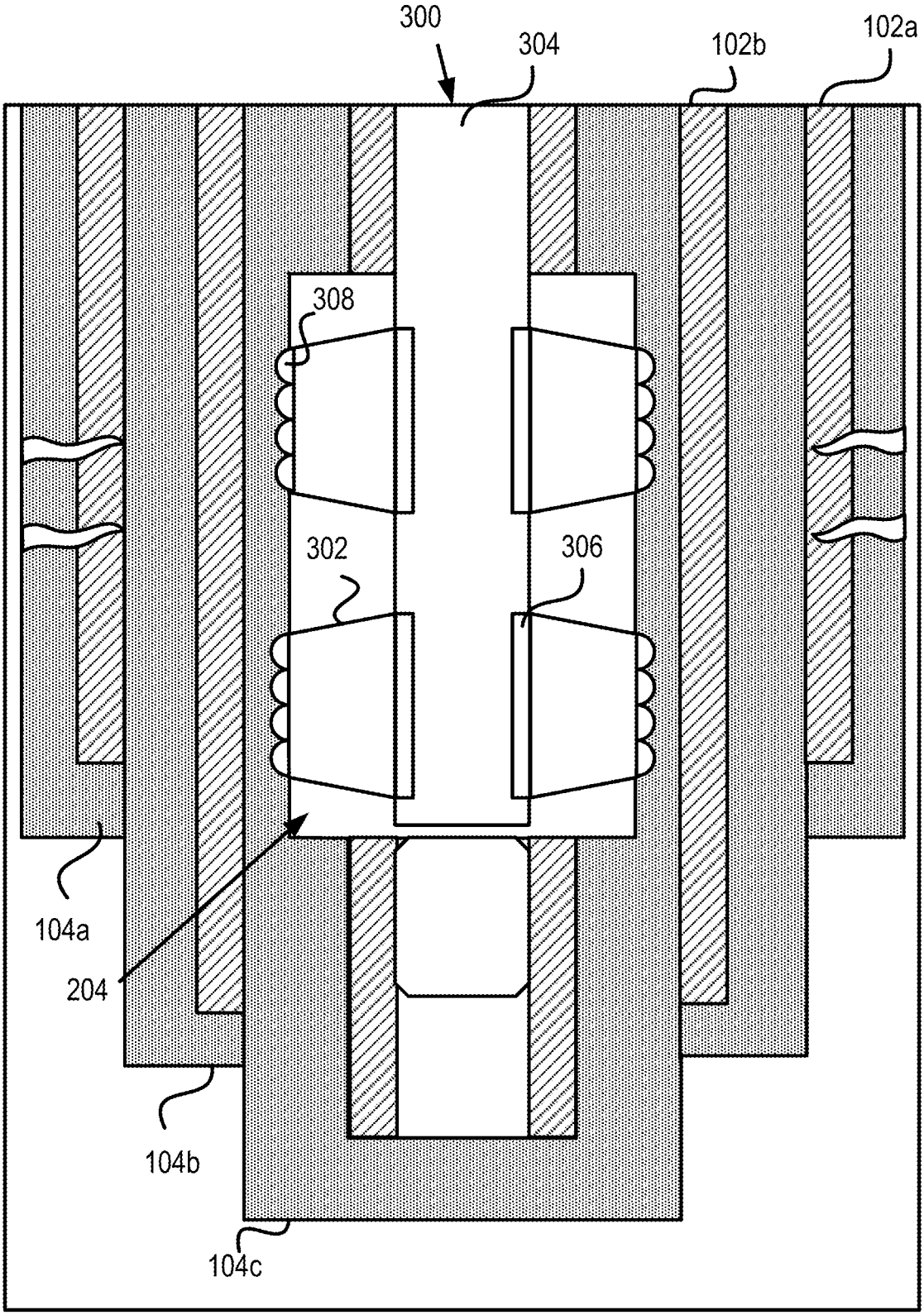
FIG. 3 is a schematic cross-sectional side view of the wellbore with a cement cleanout tool inserted therein for progressive removal of cement columns, according to subsequent steps of the repair operation.

FIG. 3 is a schematic cross-sectional side view of the wellbore with a cement cleanout tool 300 inserted therein for progressive removal of cement columns 104*a-c*, according to one or more embodiments of the present disclosure. Following milling of the window 204 within the third casing string 102*c*, the cement cleanout tool 300 may be positioned within the wellbore flowpath 108 to expand the window 204 radially outward through the third cement column 104*c*. The expansion of the window 204 via the cement cleanout tool 300 may expose an inner surface of the second casing string 102*b* to enable further milling operations. Operation of the cement cleanout tool 300 may include deploying one or more retractable cleanout blocks 302 that may be deployable from the cleanout body 304 of the cement cleanout tool 300. The cleanout body 304 may include one or more block slots 306 defined therein to enable retraction and deployment of the retractable cleanout blocks 302. The retractable cleanout blocks 302 may include one or more cutter elements 308 mounted thereon, such that rotation of the cement cleanout tool 300 may cut into and clean out the cement columns 104*b-c* until reaching the inner surface of the second casing string 102*b*.

Further operations of the casing milling tool 200 and cement cleanout tool 300 may be performed as needed to reach the location of the leaks 106. In some embodiments, the leaks 106 may be located within the second or third cement columns 104*b-c*, and the illustrated operations may be sufficient to reach the leaks 106 for repair. However, as in the illustrated embodiment, the leaks 106 may be located behind or within the first casing string 102*a* of a concentric casing string series. As such, progressively larger casing milling tools 200 and cement cleanout tools 300 may be utilized to expand the window 204 radially outward until reaching the location of the leaks 106. Further, while three concentric casing strings 102*a-c* are illustrated here, the casing milling tool 200 and cement cleanout tool 300 may be deployed through any number of casing strings 102*a-c* without departing from the scope of this disclosure. In the illustrated embodiment, the milling and cement cleanout process may be performed up until the window 204 is in fluid communication with the leaks 106 (see FIG. 4). In further embodiments, however, the milling and cement cleanout process may continue through the leaks 106 to clean out the first cement column 104*a* where the leaks 106 are present, such that only the window 204 is present therein.

Figure 4:
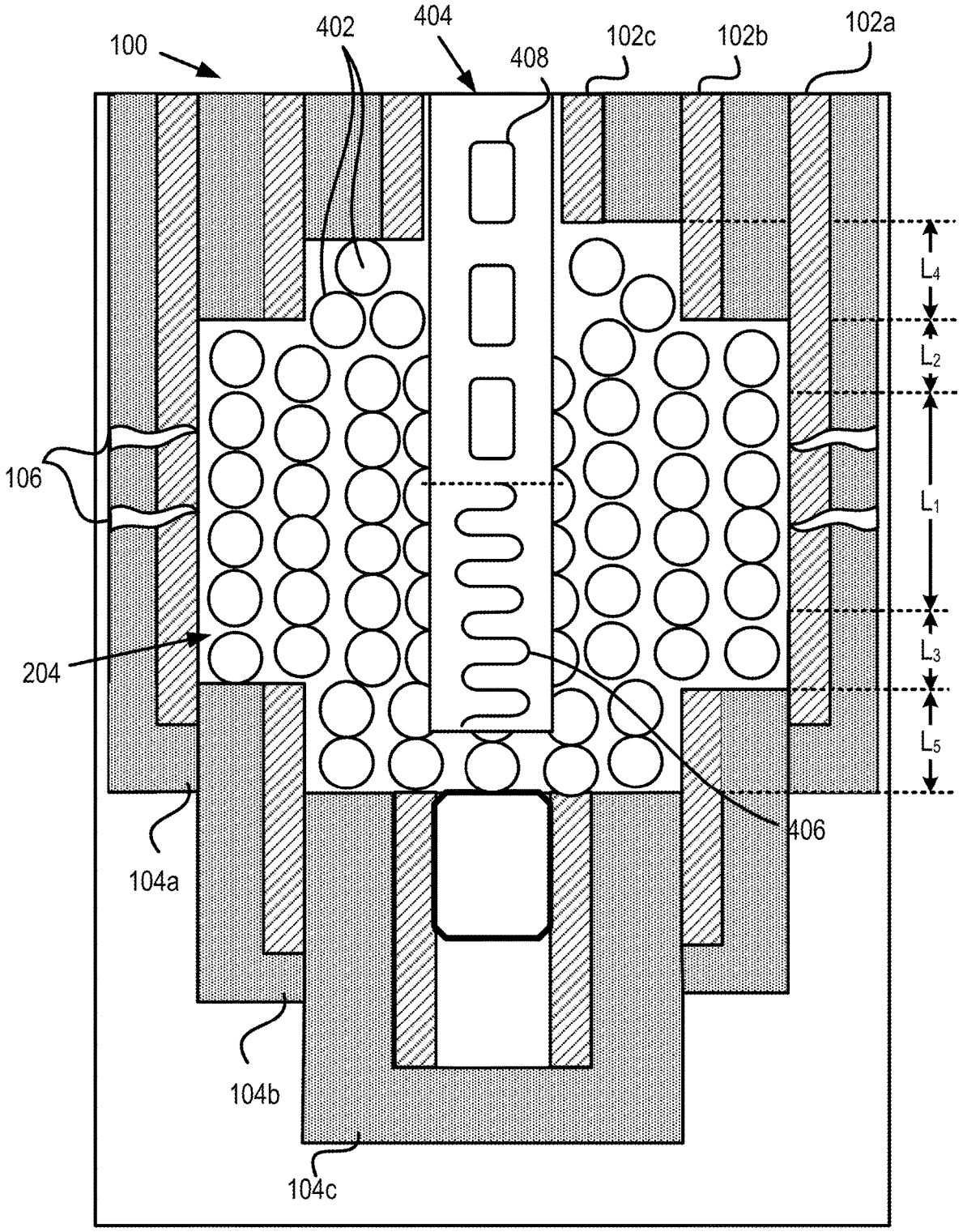
FIG. 4 is a schematic cross-sectional side view of the wellbore with eutectic alloy beads inserted therein, according to subsequent steps of the repair operation.

FIG. 4 is a schematic cross-sectional side view of the wellbore 100 with eutectic alloy beads 402 inserted therein, according to one or more embodiments of the present disclosure. The eutectic alloy beads 402 generally fill the window 204, which extends through a plurality of casing strings 102*b-c* and cement columns 104*b-c*. In some embodiments, the outermost or first casing string 102*a* may remain un-milled, such that the eutectic alloy beads 402 are inserted against interior surfaces of the first casing string 102*a*. In other embodiments, a portion of the first casing string 102*a* may be milled out such that the window 204 extends for a first axial length $L_1$ along the first casing string 102*a*. The first axial length $L_1$ may be milled out until the leaks 106 are in fluid communication with the window 204 for filling and repair. As illustrated in FIG. 4, where the first casing string 102*a* remains un-milled, above and below the first length $L_1$, the window 204 extends along exposed interior surfaces of the first casing string 102*a* for second and third axial lengths $L_2$ and $L_3$ respectively. Similarly, above and below the second and third axial lengths $L_2$, $L_3$, the window 204 extends along exposed interior surfaces of the remaining segments of the second casing string 102*b* for fourth and fifth axial lengths $L_4$ and $L_5$ respectively. The plurality of lengths $L_{1-5}$ may determine the shape of the window 204 such that a progressively stepped window 204 is formed, as illustrated.

The eutectic alloy beads 402 may be formed of any metallic alloy that exhibits eutectic properties upon melting and solidifying, such as a bismuth-based alloy. Other example eutectic alloys or components may include, but are not limited to, tin, silver, iodine, lead, cadmium, indium, and any combination thereof. In some embodiments, the eutectic alloy beads 402 may be replaced with a solid eutectic alloy piece or blanket run downhole.

Following the gravity feeding or lowering down of the eutectic alloy beads 402 within the window 204, a heater 404 may be run downhole to a location at or near the eutectic alloy beads 402. In some embodiments, the heater 404 may be a singular heating tool including either an electrically-operated heating element 406, or one or more reactive components 408 for generating an exothermic reaction, such as a thermite reaction. The heater 404 may provide heat (thermal energy) to the eutectic alloy beads within the window 204 to begin melting of the eutectic alloy beads 402 into a molten eutectic alloy to fill in the window 204 and leaks 106. In some embodiments, following melting of the eutectic alloy beads 402, the heater 404 may be retracted out of the wellbore 100 prior to solidification of the molten eutectic alloy.

In some alternate embodiments, the eutectic alloy beads 402 may be introduced downhole along with the heater 404. In these embodiments, the eutectic alloy beads 402 may form a molten eutectic alloy prior to or after insertion into the window 204. Accordingly, the molten eutectic alloy may be directly introduced into the window 204 for solidification with or without running the heater 404 fully into the window 204. In further embodiments, the eutectic alloy beads 402 may be replaced with a eutectic alloy blanket wrapped around the heater 404. In these embodiments, the heater 404 may be run downhole and activated to melt the eutectic alloy blanket into a molten eutectic alloy for further solidification within the window 204.

Figure 5:
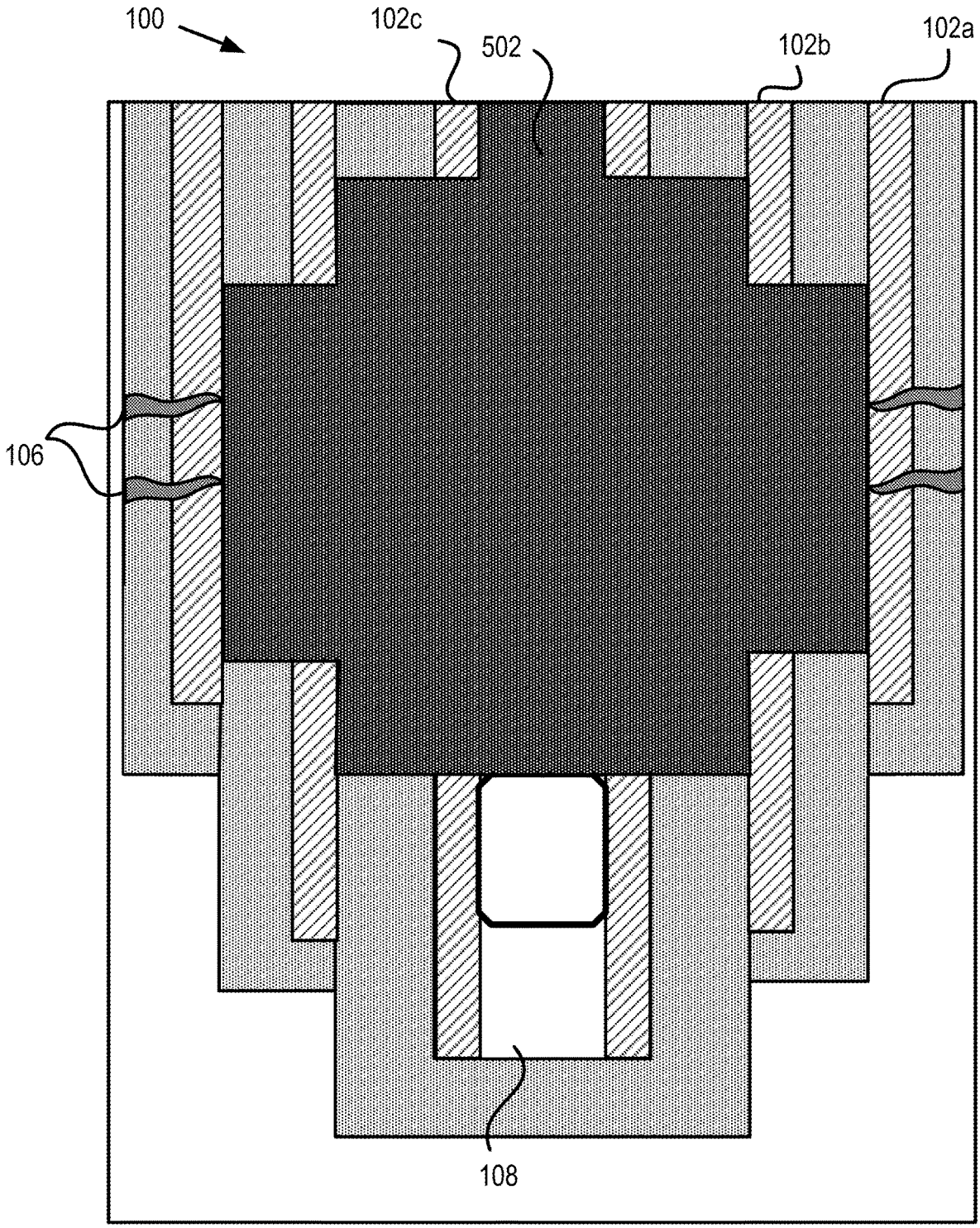
FIG. 5 is a schematic cross-sectional side view of the wellbore with a solidified eutectic plug, according to subsequent steps of the repair operation.

FIG. 5 is a schematic cross-sectional side view of the wellbore 100 with a solidified eutectic plug 502 formed therein, according to one or more embodiments of the present disclosure. As shown in the illustrated embodiment, the molten eutectic alloy has hardened into a solidified eutectic plug 502 which has expanded to fill the leaks 106, the window 204, any micro-annuli forming leak paths, and the wellbore flowpath 108. The solidified eutectic plug 502 may form a gas-tight seal within any voids present in the wellbore 100 above the plug 202. In some embodiments, the solidified eutectic plug 502 may bond to the casing strings 102*a-c* at exposed surfaces within the axial lengths of the window 204. In these embodiments, a metal-to-metal seal may be created within the wellbore 100, such that a quality gas-tight seal is present between the casing strings 102*a-c* and the solidified eutectic plug 502. Accordingly, any leaks 106 or other failures may be filled and plugged, such that any sustained casing pressure issues may be remediated. In some embodiments, the eutectic alloy beads 402 and the solidified eutectic plug 502 may utilize low amounts of heat for melting. Accordingly, the solidification process to form the solidified eutectic plug 502 may take minutes as opposed to one or more days for resin-based plugs.

Figure 6:
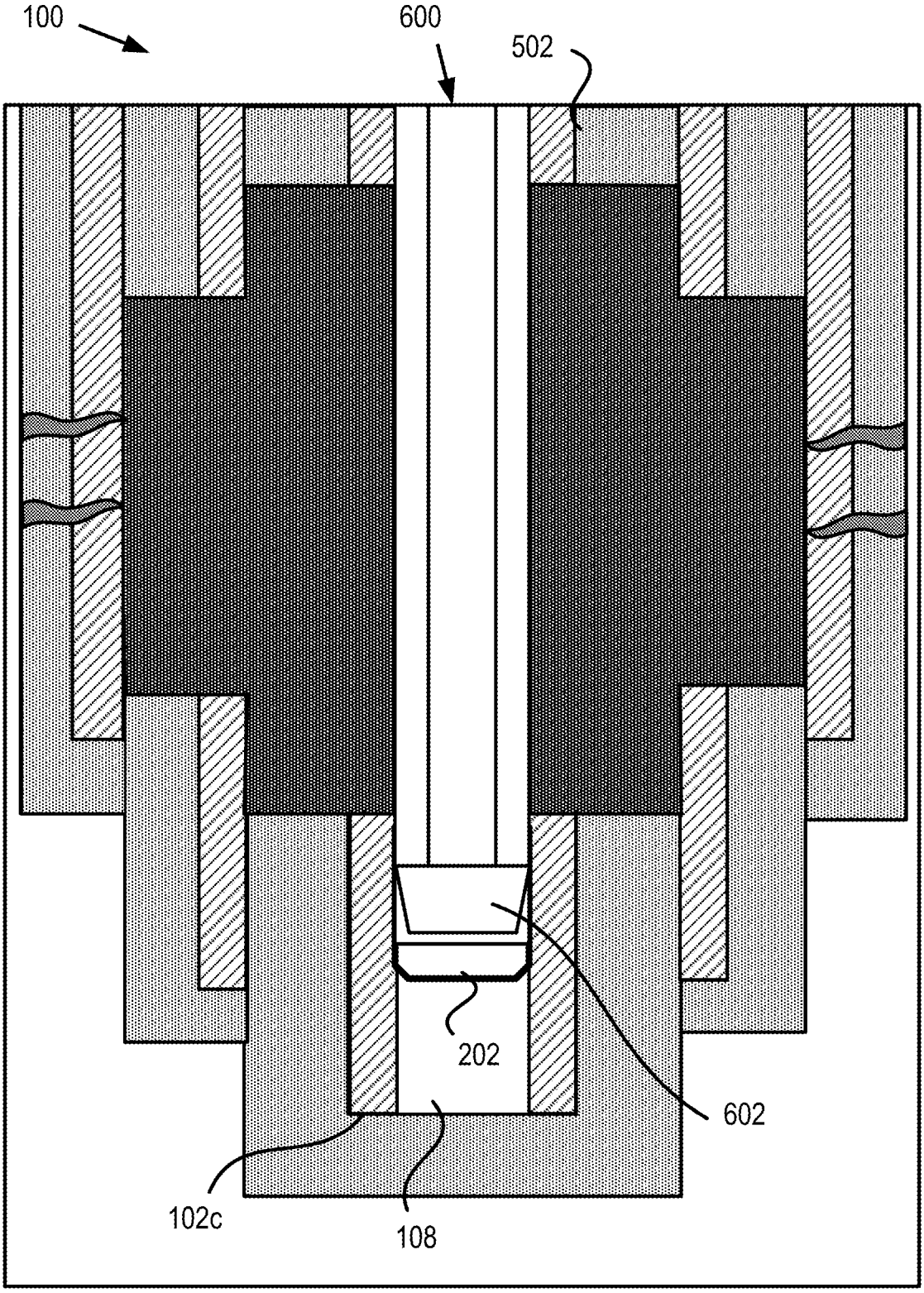
FIG. 6 is a schematic cross-sectional side view of the wellbore with a drill string inserted therein, according to subsequent steps of the repair operation.

FIG. 6 is a schematic cross-sectional side view of the wellbore 100 with a drill string 600 arranged therein, according to one or more embodiments of the present disclosure. The drill string 600 may include a drill bit 602 operable to drill through the eutectic alloy chosen for the eutectic alloy beads 402 and solidified eutectic plug 502. In some embodiments, the drill bit 602 may be a mill or milling element capable of milling through the eutectic alloy. The drill string 600 may be advanced within the wellbore flowpath 108 until the drill bit 602 reaches the solidified eutectic plug 502. As shown in the illustrated embodiment, the drill bit 602 may then be utilized in drilling out the wellbore flowpath 108 through both the solidified eutectic plug 502 and the plug 202. In some embodiments, the plug 202 may be a retrievable bridge plug set within the wellbore flowpath 108. In these embodiments, the drill bit 602 may drill out the solidified eutectic plug 502 up to the plug 202, at which point the plug 202 may be unset and retracted out of the wellbore 100, or entirely milled out. Regardless of the type of plug 202 utilized, the wellbore flowpath 108 may be restored through the repaired area to enable further use of the wellbore 100. The drill bit 602 may be chosen to match the diameter of the third casing string 102*c*, such that the wellbore flowpath 108 may remain constantly sized throughout the wellbore 100.

Figure 7:
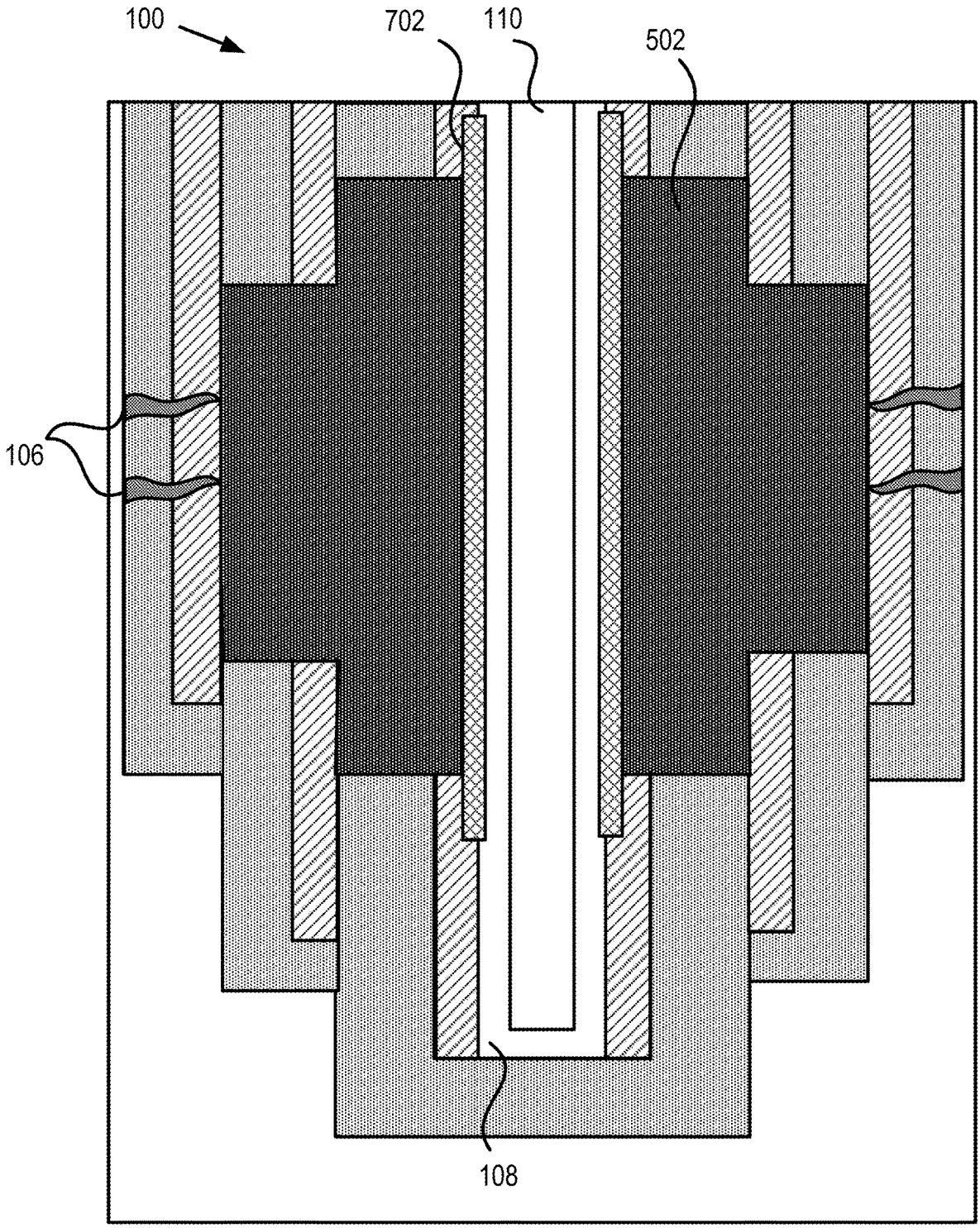
FIG. 7 is a schematic cross-sectional side view of the wellbore with production tubing reinstalled, according to subsequent steps of the repair operation.

FIG. 7 is a schematic cross-sectional side view of the wellbore 100 with a scab liner 702 installed and the production tubing 110 reinstalled, according to one or more embodiments of the present disclosure. In some embodiments, as illustrated, the wellbore 100 may have a scab liner 702 installed therein. In these embodiments, the scab liner 702 may form a secondary barrier between the leaks 106 and the production tubing 110 following installation of the solidified eutectic plug 502. The production tubing 110 may be reinstalled within the wellbore flowpath 108 that includes the solidified eutectic plug 502 after drilling. The production tubing 110 may then be reutilized in hydrocarbon production operations within the wellbore 100 without sustained casing pressure. The scab liner 702 may be set around the wellbore flowpath 108 to allow the production tubing 110 to pass therethrough. In alternate embodiments, a bridge plug may be utilized as a scab liner 702 such that flow may pass through the bridge plug as desired without the production tubing 110 being directly placed in the repaired area. In some embodiments, however, the gas-tight metal seal of the eutectic alloy packer 502 may be sufficient in repairing the leaks 106, and thus the scab liner 702 may be omitted.

Through the progressive utilization of the eutectic alloy system as shown in FIGS. 2-7, the sustained casing pressure may be remediated within the concentric casing strings 102*a-c* and cement columns 104*a-c*. The eutectic alloy system may include, but is not limited to, the plug 202, the casing milling tool 200, the cement cleanout tool 300, the eutectic alloy beads 402, the heater 404, the drill string 600, the scab liner 702, and any components thereof that are utilized in the embodiments illustrated herein.

Figure 8:
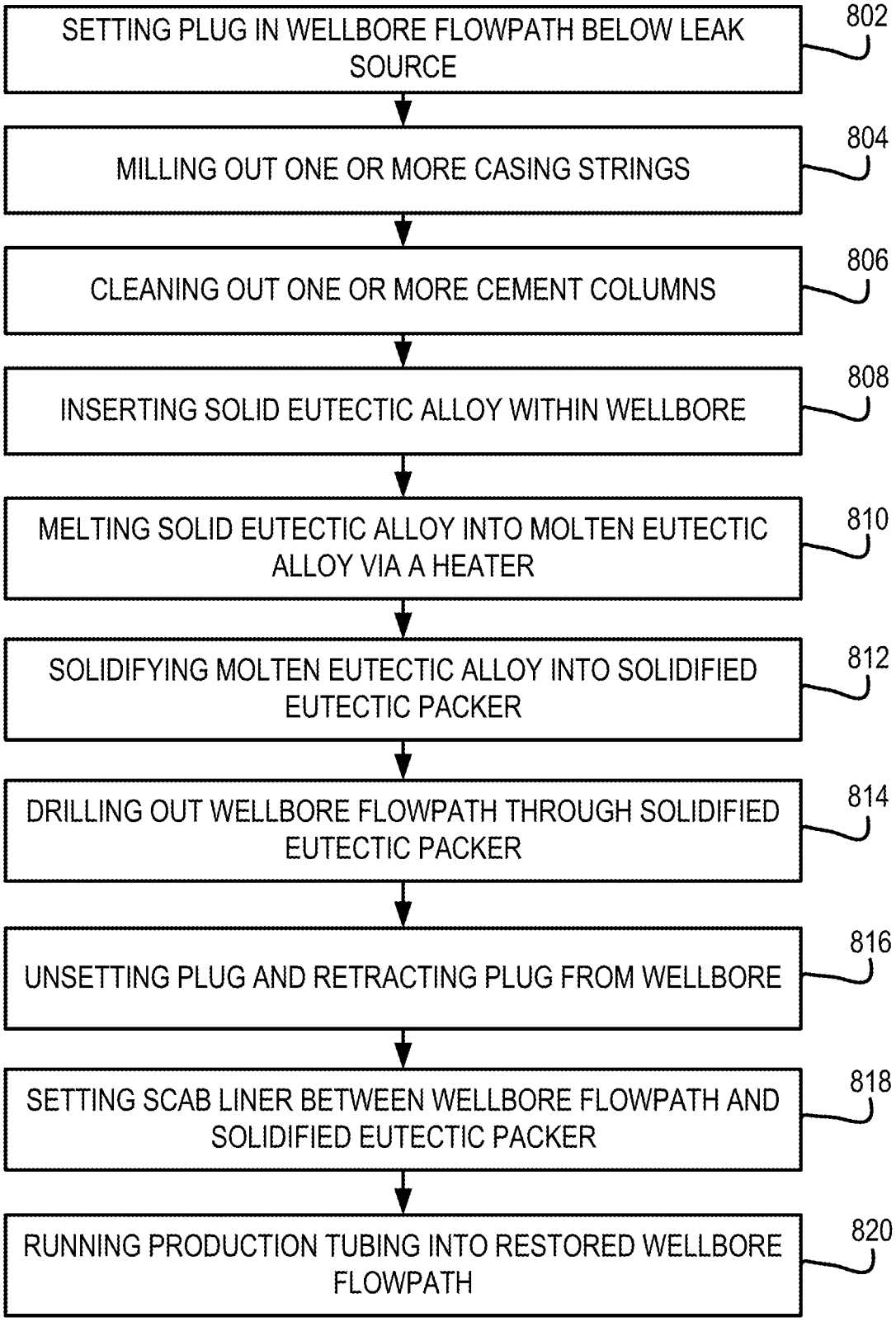
FIG. 8 is a schematic flowchart of an example method for correcting a leak within concentric casing strings via a eutectic alloy system.

FIG. 8 is a schematic flowchart of an example method 800 for correcting a leak (e.g., the leaks 106) within concentric casing strings (e.g., concentric casing strings 102*a-c*) via a eutectic alloy system. The method 800 may include setting a plug (e.g., the plug 202) within the wellbore flowpath (e.g., the wellbore flowpath 108) near, above or below the location of the leaks at 802. The setting of the plug at 802 may enable further repair processes to be performed within the wellbore (e.g., the wellbore 100) near the leaks without affecting the remainder of the wellbore flowpath. The plug may be a drillable plug which may be drilled out at a later time, or may be an expandable, retrievable plug which may be collapsed and retracted out of hole following repairs.

The method 800 may include milling out a portion of concentric casing string via a casing milling tool (e.g., the casing milling tool 200) at 804. The milling of the concentric casing string may create a window (e.g., the window 204) within the concentric casing string. The window milled out at 804 may enable access to one or more cement columns (e.g., the one or more cement columns 104*a-c*) within the wellbore flowpath. The method 800 may further include cleaning out one or more cement columns behind the concentric casing string at 806 via a cement cleanout tool (e.g., the cement cleanout tool 300). The cement cleanout tool may be deployable within the wellbore flowpath to expand the window through one or more cement columns to provide access to the leaks or another concentric casing string for further operations. In some embodiments, three or more concentric casing strings may be installed within the wellbore for deeper operations. In these embodiments, based on the locations of the leaks, the milling at 804 and cleaning out at 806 may be repeated in progressive operations until the leaks are in fluid communication with the window and wellbore flowpath. In some embodiments, cleaning out the cement columns may expose interior surfaces of one or more concentric casing strings.

The method 800 may include inserting a solid eutectic alloy within the wellbore at 808. In some embodiments, the solid eutectic alloy may be in the form of eutectic alloy beads (e.g., the eutectic alloy beads 402). In further embodiments, however, the solid eutectic alloy may be one solid piece or a blanket run downhole. The solid eutectic alloy inserted at 808 may be of a sufficient amount to fill the window generated via milling and cleaning out of cement, and may depend on the location of the leak and the corresponding number of milled or cleaned out sections. The method may further include melting the solid eutectic alloy into a molten eutectic alloy via a heater (e.g., the heater 404) at 810. The heater may be an electrical or chemical heater that may provide enough heat to melt the solid eutectic alloy into a molten eutectic alloy. Following successful melting of the solid eutectic alloy at 810, the heater may be retracted out of the wellbore to be reused in further operations.

The method may include solidifying the molten eutectic alloy into a solidified eutectic plug (e.g., the solidified eutectic plug 502) at 812. The solidified eutectic plug may expand and fill the leaks and window to form a gas-tight seal within the wellbore flowpath to prevent any sustained casing pressure in the location of the leaks. The solidifying of the molten eutectic alloy may occur over a period of minutes, as opposed to hours or days required for resin-based plugs. Accordingly, the solidified eutectic plug may be rapidly deployed and utilized in sustained casing pressure remediation without extensive downtime. The method 800 may further include drilling out the wellbore flowpath through the solidified eutectic plug at 814 via a drill string (e.g., the drill string 600). The drill string may include a drill bit (e.g., the drill bit 602) installed thereon for drilling out of the solidified eutectic plug in the same diameter as the wellbore flowpath. In some embodiments, the drilling out of the wellbore flowpath at 814 may include drilling through the plug previously set at 802. In further embodiments, however, the method 800 can include unsetting the plug and retracting the plug out of hole at 816 for embodiments utilizing expandable, retrievable plugs.

In some embodiments, the method 800 may continue at 818 with running a scab liner (e.g., the scab liner 702) within the wellbore flowpath to the location of the solidified eutectic plug. The scab liner may be set at 818 to provide a further barrier between wellbore flowpath and the location of the leaks. Further, the scab liner may provide a layer of protection between production equipment and the drilled out eutectic alloy. The method 800 may further include running production tubing (e.g., the production tubing 110) within the wellbore flowpath including the leak remediation therein at 820. The running of production tubing 110 may enable further wellbore operations within the wellbore without sustained casing pressure, such that normal operations of the wellbore may continue.

Figure 9:
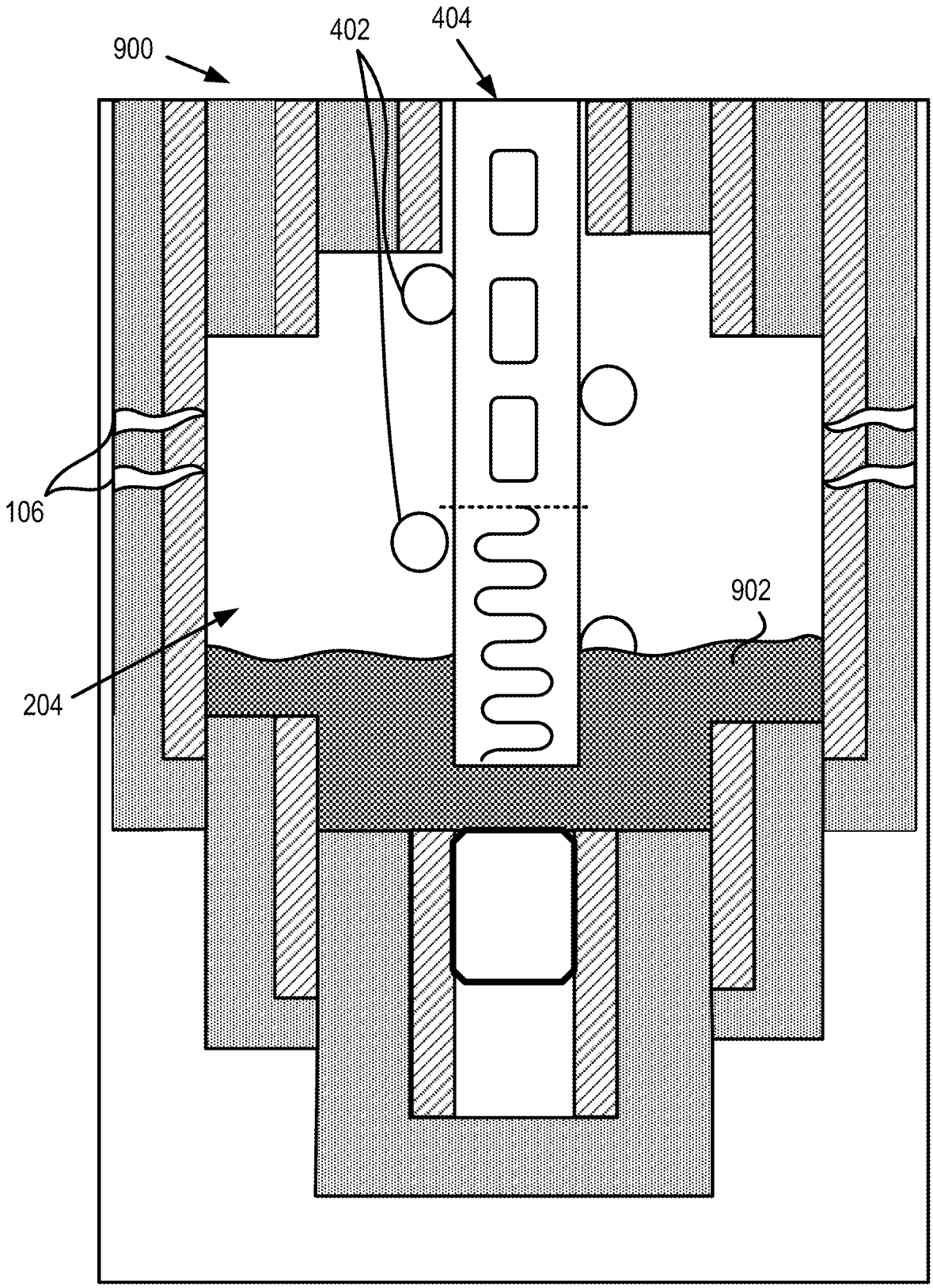
FIG. 9 is a schematic cross-sectional side view of an alternate embodiment of a wellbore with eutectic alloy beads actively melting therein.

FIG. 9 is a schematic cross-sectional side view of an alternate wellbore 900 with eutectic alloy beads 402 actively melting therein, according to one or more embodiments of the present disclosure. The alternate wellbore 900 includes leaks 106 within the first cement columns 104*a* and the first casing string 102*a*. Accordingly, a window 204 may be defined, via the casing milling tool 200 and cement cleanout tool 300, up to the leaks 106 for repairing the casing-casing annulus.

In the illustrated embodiment, the heater 404 may be run into the window 204 prior to insertion of any eutectic alloy beads 402, or alternatively, some or all of the eutectic alloy beads 402 may be introduced into the window 204, and the heater 404 may be subsequently introduced into the window 204 to melt the eutectic alloy beads 402. In other embodiments, the eutectic alloy beads 402 may be coupled to or carried by the heater 404 such that the eutectic alloy beads 402 and the heater 404 may be lowered downhole together, and the heater 404 may be activated upon reaching the window 204. The heater 404 may be activated and ready to melt the eutectic alloy beads 402 upon insertion. Accordingly, as the eutectic alloy beads 402 are introduced downhole, the heater 404 may actively melt the eutectic alloy beads into the molten eutectic alloy 902. In some embodiments, the eutectic alloy beads 402 may continue to be introduced downhole until the window 204 is filled with molten eutectic alloy 902. The heater 404 may be withdrawn and the molten eutectic alloy 902 may be left to solidify and expand to generate a solidified eutectic plug 502 (FIG. 5), prior to continuation of the repair process.

Embodiments disclosed herein include:

A. A method of repairing wellbores comprising setting a plug to isolate a wellbore flowpath within a plurality of concentric casing strings, milling a window through a radially innermost casing string of the plurality of concentric casing strings, via a casing milling tool, and radially outward towards one of a plurality of cement columns, cleaning out one of plurality of a cement columns between two of the concentric casing strings to expand the window radially, inserting a solid eutectic alloy into the wellbore flowpath above the plug, heating the solid eutectic alloy, via a heater inserted within the wellbore flowpath, to melt the eutectic alloy and allow the melted eutectic alloy to flow into the window, solidifying the melted eutectic alloy to form a solidified eutectic plug within the window, and drilling out the solidified eutectic plug to restore the wellbore flowpath through the eutectic plug.

B. A wellbore repair system comprising a plurality of concentric casing strings disposed within a wellbore, a plurality of cement columns disposed radially outward of each of the concentric casing strings, a window defined radially through at least a radially innermost casing string of the one or more of the concentric casing strings, a plug set within an interior of the radially innermost casing string below the window, and a solidified eutectic alloy filling the window above the plug, wherein the solidified eutectic alloy forms a metal-to-metal seal with at least one of the concentric casing strings C. A wellbore repair system comprising a plurality of concentric casing strings disposed within a wellbore, a plurality of cement columns disposed radially outward of each of the concentric casing strings, a window defined radially through at least a radially innermost casing string of the one or more of the concentric casing strings, a plug set within an interior of the radially innermost casing string, a plurality of eutectic alloy beads inserted within the window above the plug, and a heater inserted within the window and operable to melt the plurality of eutectic alloy beads.

Each of embodiments A through C may have one or more of the following additional elements in any combination: Element 1: further comprising: drilling through the solidified eutectic plug and into the plug to restore the wellbore flowpath, wherein the plug is a drillable plug. Element 2: further comprising: releasing the plug from below the drilled solidified eutectic plug; and retracting the plug from the wellbore flowpath, wherein the plug is an expandable, releasable plug. Element 3: further comprising: running a production tubing through the restored wellbore flowpath. Element 4: further comprising: setting a scab liner within the wellbore flowpath and axially spanning the window. Element 5: further comprising: milling a casing string radially outwards of the radially innermost casing string to expand the window radially outwardly. Element 6: further comprising: cleaning out a further one of the plurality of cement columns to further expand the window radially outwardly. Element 7: wherein inserting a solid eutectic alloy into the wellbore flowpath comprises inserting a plurality of eutectic alloy beads within the wellbore flowpath. Element 8: wherein the solid eutectic alloy comprises a bismuth-based alloy. Element 9: further comprising a flowpath extending through a portion of the solidified eutectic alloy.

Element 10: wherein the plug is a drillable plug and the drill string is further operable to restore the wellbore flowpath through the drillable plug. Element 11: further comprising a scab liner connected to an innermost casing string of the plurality of concentric casing strings and over the window to form a barrier between the leaks and the wellbore flowpath. Element 12: wherein the window includes a progressively stepped pattern through one or more of the plurality of cement columns disposed radially outward of the radially innermost casing string. Element 13: wherein the window further includes a progressively stepped pattern through one or more casing strings radially outwards of the radially innermost casing string. Element 14: wherein the plurality of eutectic alloy beads comprises a bismuth-based alloy. Element 15: wherein the heater includes an electrically-operated heating element.

Element 16: wherein the heater includes one or more reactive components operable to generate an exothermic reaction. Element 17: wherein the window includes a progressively stepped pattern through one or more of the plurality of cement columns disposed radially outward of the radially innermost casing string and one or more casing strings radially outwards of the radially innermost casing string.

By way of non-limiting example, exemplary combinations applicable to A through C include: Element 3 with Element 4; Element 5 with Element 6; Element 9 with Element 10; Element 9 with Element 11; and Element 12 with Element 13.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A method comprising:

setting a plug to isolate a wellbore flowpath within a plurality of concentric casing strings;

milling a window through a radially innermost casing string of the plurality of concentric casing strings, via a casing milling tool, and radially outward towards one of a plurality of cement columns;

cleaning out the one of the plurality of cement columns between two of the concentric casing strings to expand the window radially;

inserting a solid eutectic alloy into the wellbore flowpath above the plug;

heating the solid eutectic alloy with a heater inserted within the wellbore flowpath and thereby melting the solid eutectic alloy and allowing a melted eutectic alloy to flow into the window;

solidifying the melted eutectic alloy to form a solidified eutectic plug filling the window and wellbore flowpath;

drilling out the solidified eutectic plug to restore the wellbore flowpath through the eutectic plug;

releasing the plug from below the drilled solidified eutectic plug; and retracting the plug from the wellbore flowpath, wherein the plug is an expandable, releasable plug.

2. The method of claim 1, further comprising:

drilling through the solidified eutectic plug and into the plug to restore the wellbore flowpath, wherein the plug is a drillable plug.

3. The method of claim 1, further comprising:

running a production tubing through the restored wellbore flowpath.

4. The method of claim 3, further comprising:

setting a scab liner within the wellbore flowpath and axially spanning the window.

5. The method of claim 1, further comprising:

milling a casing string radially outwards of the radially innermost casing string to expand the window radially outwardly.

6. The method of claim 5, further comprising:

cleaning out a further one of the plurality of cement columns to further expand the window radially outwardly.

7. The method of claim 1, wherein inserting a solid eutectic alloy into the wellbore flowpath comprises inserting a plurality of eutectic alloy beads within the wellbore flowpath.

8. A wellbore repair system, comprising:

a plurality of concentric casing strings disposed within a wellbore;

a plurality of cement columns disposed radially outward of each of the concentric casing strings;

a window defined radially through at least a radially innermost casing string of the one or more of the concentric casing strings and a radially innermost cement column of the plurality of cement columns;

a plug set within an interior of the radially innermost casing string below the window; and a solidified eutectic alloy filling the window and a wellbore flowpath above the plug, wherein the solidified eutectic alloy forms a metal-to-metal seal with at least one of the concentric casing strings, and wherein the window includes a progressively stepped pattern through one or more of the plurality of cement columns disposed radially outward of the radially innermost casing string.

9. The wellbore repair system of claim 8, wherein the solid eutectic alloy comprises a bismuth-based alloy.

10. The wellbore repair system of claim 8, further comprising a flowpath extending through a portion of the solidified eutectic alloy.

11. The wellbore repair system of claim 10, wherein the plug is a drillable plug and a drill string is operable to restore the wellbore flowpath through the drillable plug.

12. The wellbore repair system of claim 10, further comprising a scab liner connected to an innermost casing string of the plurality of concentric casing strings and over the window to form a barrier between the leaks and the wellbore flowpath.

13. The wellbore repair system of claim 8, wherein the window further includes a progressively stepped pattern through one or more casing strings radially outwards of the radially innermost casing string.

14. A wellbore repair system comprising:

a plurality of concentric casing strings disposed within a wellbore;

a plurality of cement columns disposed radially outward of each of the concentric casing strings;

a window defined radially through at least a radially innermost casing string of the one or more of the concentric casing strings and a radially innermost cement column of the plurality of cement columns;

a plug set within an interior of the radially innermost casing string;

a plurality of eutectic alloy beads inserted within the window above the plug; and a heater inserted within the wellbore and operable to melt the plurality of eutectic alloy beads, wherein the window includes a progressively stepped pattern through one or more of the plurality of cement columns disposed radially outward of the radially innermost casing string.

15. The wellbore repair system of claim 14, wherein the plurality of eutectic alloy beads comprises a bismuth-based alloy.

16. The wellbore repair system of claim 14, wherein the heater includes an electrically-operated heating element.

17. The wellbore repair system of claim 14, wherein the heater includes one or more reactive components operable to generate an exothermic reaction.

18. The wellbore repair system of claim 14, wherein the progressively stepped pattern of the window further extends through one or more casing strings disposed radially outwards of the radially innermost casing string.

* * * * *